United States Patent [19]

Greeson

[11] 4,441,685

[45] Apr. 10, 1984

[54] COLUMN FORM

[76] Inventor: Logan C. Greeson, 1286 Marine Dr., West Palm Beach, Fla. 33409

[21] Appl. No.: 434,190

[22] Filed: Oct. 14, 1982

[51] Int. Cl.[3] ..... B29C 1/16

[52] U.S. Cl. ..... 249/51; 249/48; 249/219 R; 264/32; 425/451.7

[58] Field of Search ..... 249/48, 49, 51, 143, 249/219 R; 264/32; 435/450.1, 451.7

[56] References Cited

U.S. PATENT DOCUMENTS

| | | | |
|---|---|---|---|
| 3,159,898 | 12/1964 | VanName | 249/51 |
| 3,558,095 | 1/1971 | McNiel | 249/13 |
| 3,574,905 | 4/1971 | Jing-Hong | 425/63 |

*Primary Examiner*—Donald E. Czaja
*Assistant Examiner*—Mary A. Becker
*Attorney, Agent, or Firm*—Harvey B. Jacobson

[57] ABSTRACT

Inner and outer upstanding peripheral frames are provided and include corresponding inner and outer sides spaced relative to each other. Upper and lower parallelogram links are pivotally connected at opposite ends to each pair of corresponding inner and outer sides and structure is provided for lifting the outer frame. Upper and lower pairs of coacting inner and outer wedge structure is carried by each pair of corresponding inner and outer sides engageable with each other upon downward displacement of the outer frame relative to the inner frame to limit such downward displacement to a lower position of said outer frame with said links substantially horizontally disposed and engageable with each other upon upward displacement of the outer frame relative to the inner frame to limit such upward displacement to an upper position of the outer frame with the links upwardly and outwardly inclined. The sides of the outer frame are mounted to each other against relative movement.

14 Claims, 10 Drawing Figures

56
54
58
120
118
60
52
62
50
64
70
66
112
72
14
68
48
48
16
82
10
12
18
74
76
20
80
78

52
50
96
96
48
48
5
22
14
40
34
22
38
16
5
38
20
116

28
30
96
32
30
48
96
48
92
12
86
82
10
34
34
96
90
22
96
88
92
38
84
76
36
40
40
22
98
100
80

COLUMN FORM

BACKGROUND OF THE INVENTION

Many buildings are presently constructed by forming poured concrete columns upon a foundation and thereafter pouring the next upper deck or floor substantially flush with the upper ends of the last poured columns and with the next upper deck being formed in the same manner and supported atop columns poured in position over the upper ends of the last poured columns.

The pouring of these columns is accomplished by erecting an upstanding tubular form in each location in which a column is to be poured with the form containing vertical reinforcing rods tied to the upper ends of reinforcing rods which project above the upper ends of the last poured column. The inner surfaces of the form are coated with a release substance to facilitate removal of the form from about the column to be formed after the column has cured. When the release substance has been applied to the inner surfaces of the form the desired cement or concrete mixture may be poured into the form and compacted by a suitable vibratory tool.

The time expended in erecting a plurality of the forms in the desired positions and subsequently at least partially disassembling the forms from about cured columns represents a considerable number of man hours. Accordingly, a need exists for an improved form which may be more quickly erected in the desired position and more quickly removed from about a cured column independent of disassembly of the form.

Examples of various types of forms including some of the general structural and operational features of the instant invention are disclosed in U.S. Pat. Nos. 3,260,493, 3,519,242, 3,558,095, 3,574,905, 3,595,514, 3,795,393 and 4,301,990.

BRIEF DESCRIPTION OF THE INVENTION

The column form of the instant invention includes upstanding inner and outer frames including opposing corresponding vertical sides. The sides of the outer frame are secured together against relative displacement and the sides of the inner frame are supported from the corresponding sides of the outer frame for inward and outward movement relative thereto and to each other. Structure is provided for attaching a lifting line to the outer frame and upper and lower parallelogram links are pivotally connected at their opposite ends to each pair of corresponding outer and inner sides. Further, each pair of corresponding inner and outer sides includes upper and lower pairs of coacting inner and outer wedge means carried thereby and the wedge means are engageable with each other upon downward displacement of the outer frame relative to the inner frame to limit such downward displacement to a lower position of the outer frame with the links substantially horizontally disposed and further engageable with each other upon upward displacement of the outer frame relative to the inner frame to limit such upward displacement to an upper limit position of the outer frame with the links upwardly and outwardly inclined.

When the outer frame is displaced downwardly relative to the inner frame to its lower position the inner sides comprising the inner frame are displaced inwardly relative to each other into adjacent upstanding side edge abutting relation in order to form a peripherally continuous tubular form into which cement or concrete may be poured. After the concrete has been cured, the outer frame is upwardly displaced relative to the inner frame by applying a lifting force on the outer frame and as the outer frame is elevated relative to the inner frame and the links swing from substantially horizontal positions toward upwardly and outwardly inclined positions, the sides of the inner frame are displaced outwardly toward the corresponding sides of the outer frame. In this manner, the inner sides comprising the form are displaced outwardly relative to the opposing surfaces of the cured column previously poured therein. Therefore, the column form may be readily stripped from the cured column.

In addition, after the form has been lifted from about the last cured column formed therein, it may be readily moved by the lifting crane to the next position in which a column is to be formed and lowered into the desired position. As the form is lowered into final position and the lower ends of the sides of the inner frame contact the last poured deck, downward movement of the inner frame is terminated and the outer frame continues to move downwardly relative to the inner frame to the lower position thereof thereby automatically again inwardly displacing the sides of the inner frame into position with adjacent upstanding marginal edges thereof contacting each other and thus forming a peripherally continuous form with the inner frame.

The main object of this invention is to provide a column form which may be quickly placed about upstanding reinforcing rods to be embedded in a column to be subsequently poured in the form.

Another object of this invention is to provide a column form in accordance with the preceding objects and which may be quickly removed from about a cured column.

Still another object of this invention is to provide a form in accordance with the two immediately preceding objects and which may be placed in position and removed from about a cured column independent of any assembly or disassembly of the form.

Still another object of this invention is to provide a column form including upper end structure which may be utilized to automatically maintain the upper ends of the reinforcing rods to be contained in the column to be poured in proper position as the column is being poured.

A further object of this invention is to provide a column form including structure which enable the form to be supported in plumb position independent of the use of a plurality of the presently used adjustable length inclined bracing members.

Another important object of this invention is to provide accessory equipment which will enable a plumb position of the form to be readily determined.

A further object of this invention is to provide additional accessory equipment which will facilitate the pouring of concrete into the form through the utilization of a crane supported AERIAL concrete container.

A final object of this invention to be specifically enumerated herein is to provide a form in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 6:
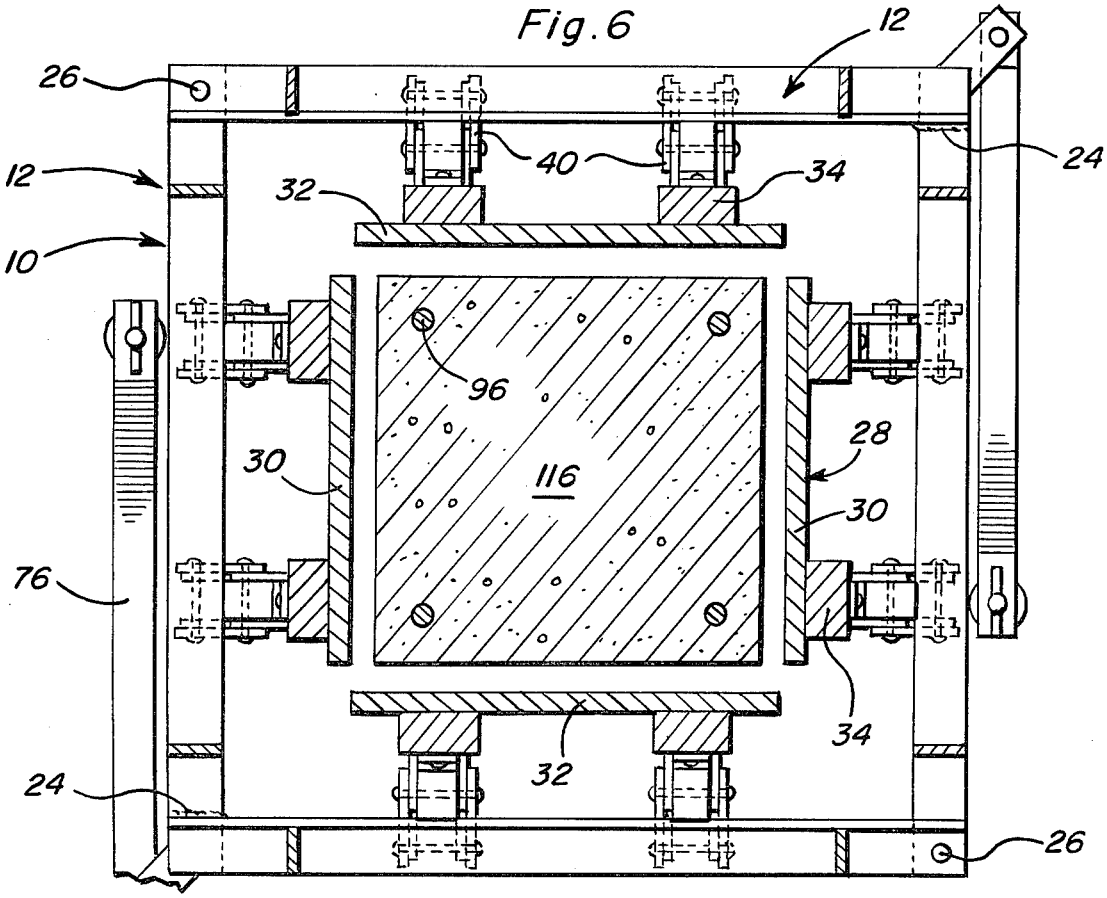
FIG. 6 is a horizontal sectional view taken substantially upon the plane indicated by the section line 6—6 of FIG. 5.

Referring now more specifically to the drawings the numeral 10 generally designates the column form of the instant invention. The form 10 includes an outer frame referred to in general by the reference numeral 12 including four vertically spaced peripheral frames 14, 16, 18 and 20. Each of the frames 14, 16, 18 and 20 comprises a peripherally continuous four sided frame constructed of angle iron and the frames of the outer frame are interconnected on each side of the outer frame 12 by vertical members 22 extending and secured between corresponding portions of the vertically spaced frames. The angle members of each of the vertically spaced frames are secured together as by welding 24 at diametrically opposite corners of the frames and the other pair of diametrically opposite corners of the frames are interconnected through the utilization of removable shank type fasteners 26, see FIG. 6, whereby one set of corresponding removable fasteners 26 may be removed in order to swing opposing halves of the frame away from each other toward open positions. Although it is usually not necessary to "open" the outer frame 12 in this manner, it is sometimes desirable in order that certain structural or support members may be properly positioned for embedding in a concrete column to be poured within the form 10.

The form 10 additionally includes an inner frame. The inner frame is referred to in general by the reference numeral 28 and includes two pairs of opposite vertically extending sides 30 and 32 with each of the sides 30 and 32 having a vertical reinforcing member 34 secured to and extending along each vertical marginal edge portion thereof.

Each of the members 34 includes a wedge structure 36 secured thereto at the level of each frame 14, 16, 18 and 20 and each of the last mentioned frames includes a pair of oppositely inclined wedge structures supported from each side of the outer frame 12 in opposing relation to a corresponding wedge structure 36. In addition, each pair of opposing wedge structures 36 and 38 is embraced between a pair of suspension links 40 pivotally supported at corresponding opposite ends to the associated wedge structure 36 as at 42 and the outer frame 12 as at 44. In addition, each pair of links 40 has a pair of registered transverse bores 46 formed therethrough for a purpose to be hereinafter more fully set forth.

Figure 4:
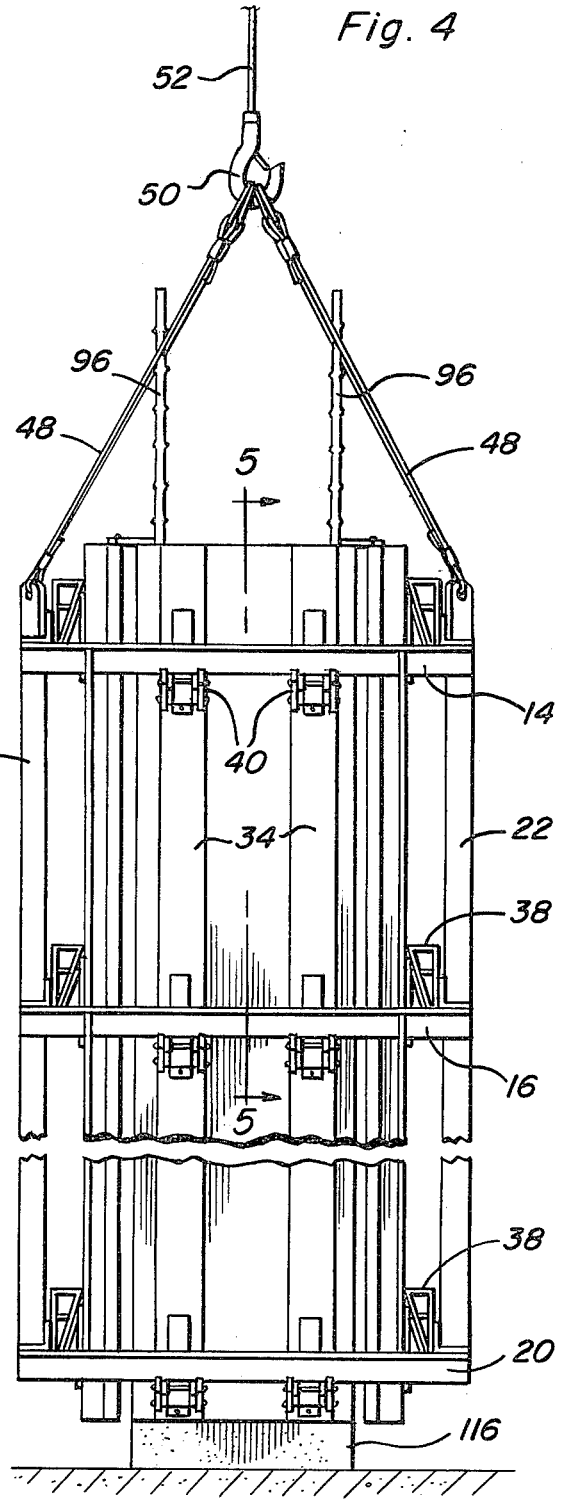
FIG. 4 is a side elevational view of the form illustrating the manner in which an upward pull on the outer frame thereof will cause upward displacement of the outer frame relative to the inner frame and the sides of the inner frame to be displaced outwardly relative to each other toward the corresponding sides of the outer frame.

The four corners of the upper frame 14 include four corner lift cables 48 anchored relative thereto whereby the four cables 48 may be used as a lifting bridle in the manner illustrated in FIG. 4 of the drawings in order that the cables may be engaged with a lifting hook 50 carried by the free end of the lifting cable 52 of a crane 54. It may be seen from FIG. 1 of the drawings that the cable 52 passes over the upper sheave 56 of the crane 54 and then depends downwardly to the hook 50. The crane 54 has a pendulum support 58 oscillatably supported therefrom for angular displacement about the axis of rotation of the sheave 56 and the lower end of the support 58 mounts a downwardly facing television camera 60. The television camera is hooked by closed circuit to a television receiver 62 to be mounted in the operator's cab of the crane 54.

Figure 1:
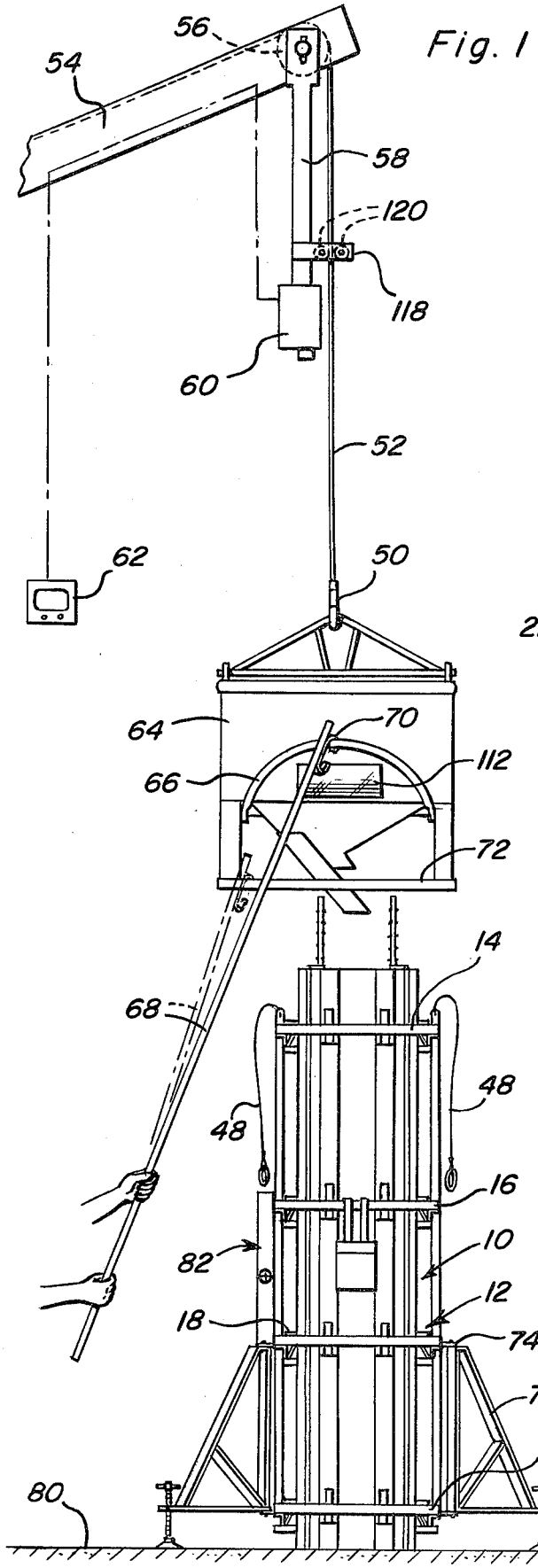
FIG. 1 is a side elevational view of the form of the instant invention mounted in position to receive concrete therein in order to form a concrete column and with a crane supported AERIAL bucket of concrete positioned above the form.

When it is desired to pour concrete into the inner frame 28, the aerial cement container or hopper 64 illustrated in FIG. 1 may be moved into position over the form 10 by the operator of the crane 54 viewing the operation through the camera 60 and receiver 62 and the bale-type dump valve operator 66 of the container 64 may be actuated through the utilization of an elongated operating wand 68 having a laterally opening C-shaped head 70 on its free end for engagement with the operator 66. In addition, further wands 68 may be engaged with the lower peripheral frame 72 of the container 64 in order that the latter may be properly positioned in vertical registry with the open upper end of the inner frame 28 for discharging concrete downwardly into the latter.

Figure 10:
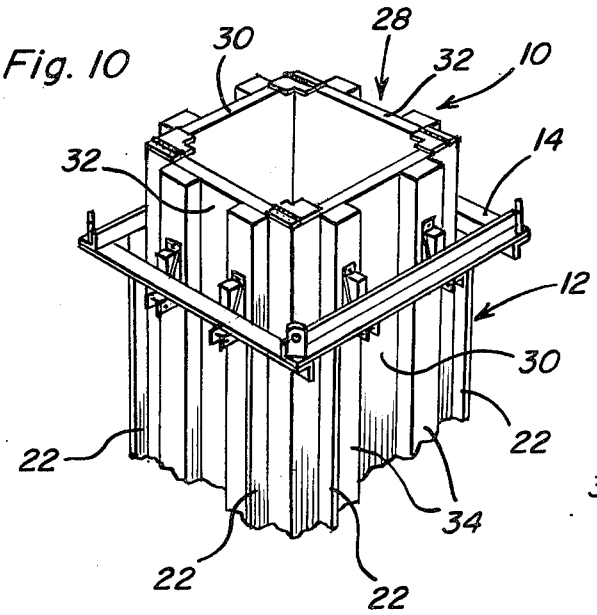
FIG. 10 is a fragmentary perspective view of the upper end of the form with the outer frame disposed in its lower position relative to the inner frame.
Figure 3:
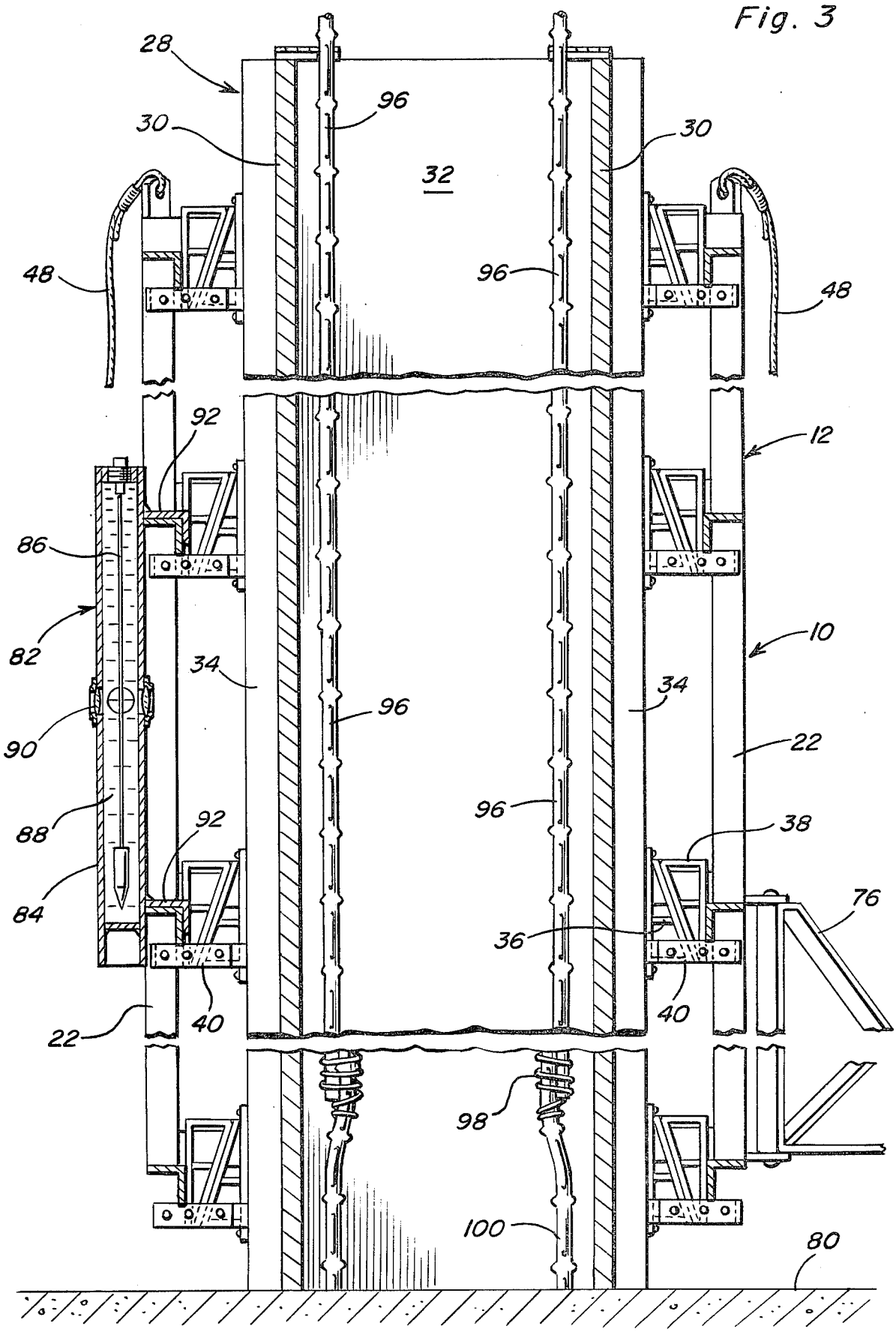
FIG. 3 is an enlarged fragmentary vertical sectional view taken substantially upon the plane indicated by the section line 3—3 of FIG. 2.

The sides 32 are wider than the sides 30 and overlap the opposite vertical edges of the sides 30 when the inner frame 28 is in the closed position illustrated in FIGS. 1, 3 and 10. In addition, the diametrically opposite corners of the outer frame 12 which are welded together at as 24 include vertically spaced outwardly projecting supports 74 from which horizontally swingable arms 76 are supported for angular displacement of each arm 76 through an arc of approximately 270°. The outer ends of the arms 76 include vertically adjustable depending and threadedly supported feet 78 for engagement with the foundation or deck 80 upwardly from which the next poured column is to project. In this manner, the form 10 may be adjusted to plumb position throughout 360°.

With attention now invited more specifically to FIG. 3 of the drawings, there may be seen a plumb bob assembly referred to in general by the reference numeral 82. The plumb bob assembly 82 comprises a vertical tubular member 84 having a weighted plumb bob line 86 centrally suspended therein. The upper and lower ends of the tubular member are closed and the interior thereof is filled with a motion dampening liquid 88 and the vertical mid-portion of the tubular body 84 includes right angularly disposed transverse windows 90 therein through which line 86 may be viewed to observe plumb throughout 360°. One side of the tubular member 84 includes vertically spaced suspension brackets 92, whereby the assembly 82 may be removably supported from selected sides of the outer frame 12 in order to check the plumb of the frame 10. Of course, if adjustments are needed to plumb the form 10, the adjustable feet 78 may be used for this purpose.

Figure 2:
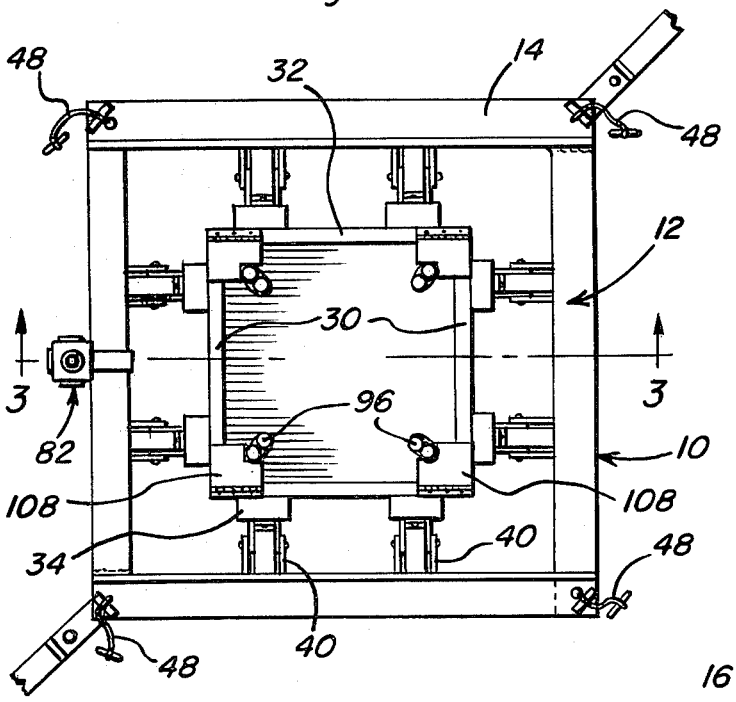
FIG. 2 is an enlarged top plan view of the form with the inner frame walls thereof in closed positions.
Figure 7:
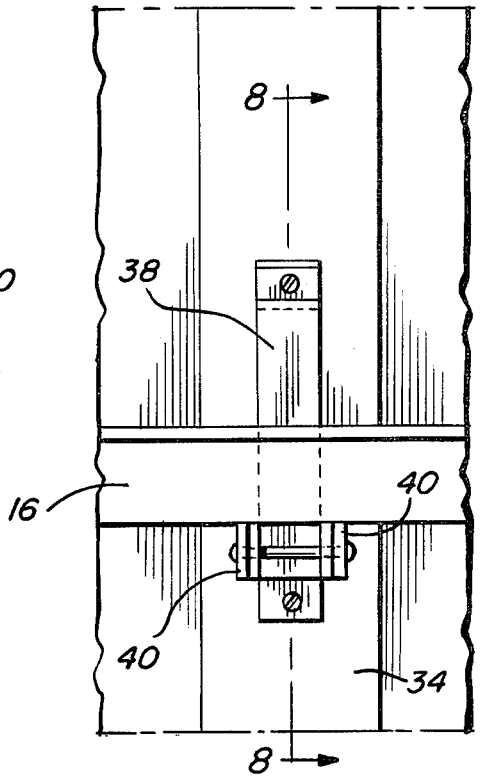
FIG. 7 is a fragmentary elevational view of one of the wedge assemblies of the form.
Figure 8:
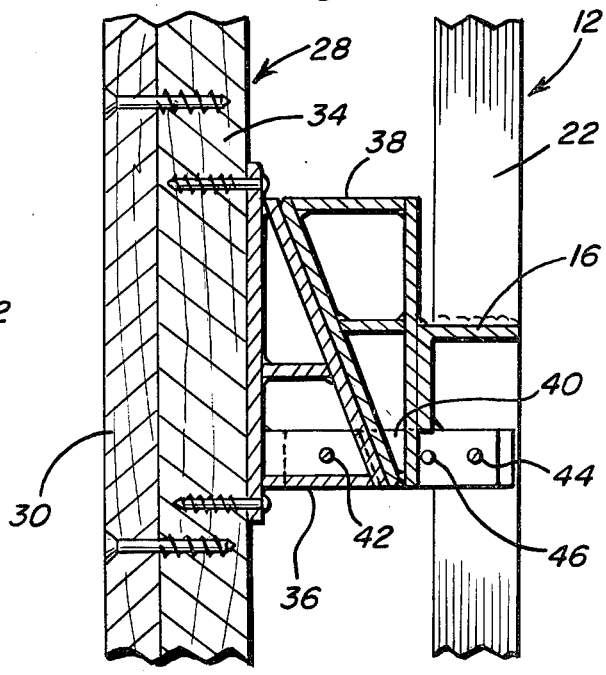
FIG. 8 is a fragmentary vertical sectional view taken substantially upon the plane indicated by the section line 8—8 of FIG. 7.

When a column is to be poured in position projecting upwardly from a deck or foundation such as that indicated as at 80 in FIGS. 1 and 3 of the drawings, vertical reinforcing bars 96 have their lower ends tied as at 98 to the upper ends of reinforcing rods 100 projecting upwardly from the deck or foundation 80. Thereafter, the form 10 is lowered into position about the reinforcing rods 96 through the utilization of the crane 54. When the form 10 is fully suspended from the cable 52, the weight of the inner frame 28 causes the latter to drop relative to the outer frame 12 to the position thereof illustrated in FIGS. 4 and 5 of the drawings. Then, as the form 10 is lowered down into position the lower ends of the sides 30 and 32 abut the deck or foundation 80 and further lowering of the form 10 causes the outer frame 12 to be lowered relative to the inner frame 28. As this final lowering of the outer frame 12 occurs, the links 40 swing from the upwardly and outwardly inclined positions thereof illustrated in FIG. 5 to the substantially horizontally disposed positions thereof illustrated in FIGS. 3 and 8 of the drawings and thereby inwardly displace the sides 30 and 32 to the relative positions thereof illustrated in FIGS. 2, 3 and 10 wherein the sides 30 and 32 define a peripherally continuous cavity in which to receive poured concrete. The bores 46 register with bores 104 defined by the outer frame 12 and latching pins (not shown) may be passed through the registered bores 46 and 104 in order to lock the inner and outer frames 28 and 12 against shifting relative to each other. Although the links 40 initially cause inward displacement of the sides 30 and 32 relative to the corresponding sides of the outer frame 12 as the latter is lowered relative to the inner frame 28, final movement of the sides 30 and 32 inward into tight engagement with each other is accomplished by the wedge structures 36 and 38. Accordingly, the inward wedging action on the sides 30 and 32 by the links 40 and the respective pivot fasteners therefor is relieved by the wedge structures 36 and 38 to insure positive and precise final inward wedging of the sides 30 and 32 into tight engagement with each other.

Figure 9:
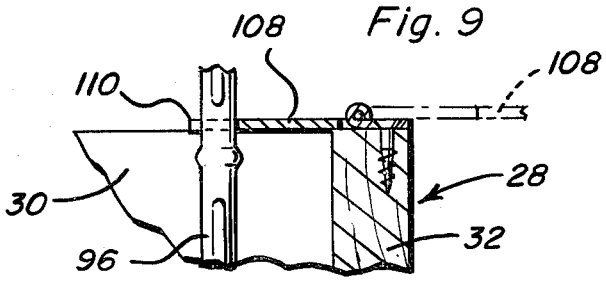
FIG. 9 is an enlarged fragmentary vertical sectional view illustrating the reinforcing bar upper end position retaining structure carried by the upper end of the inner frame of the form.

After the form 10 has been properly positioned about the reinforcing rods, reinforcing rod positioning flaps 108 pivotally supported from the upper ends of the sides 32 may be swung from the phantom line positions thereof illustrated in FIG. 9 to the solid line positions thereof illustrated in FIG. 9 whereupon the notches 110 formed in the free swinging edges of the flaps 108 may seatingly receive the upper ends of the reinforcing rods 96 and prevent outward deflection of the upper ends of the rods 96 during the process of pouring concrete into the form 10.

When it is assured that the form 10 is plumb, concrete may be poured into the form 10 from the container 64 and the concrete within the form 10 may be suitably vibrated for compaction either by a vibrator dropped into the interior of the form 10 or rigidly secured to the outer frame 12 of the form 10. Workmen standing on the deck 80 may control the operator 66 through the utilization of the wand 68 and also maintain the container 64 in proper vertical registry with the upper end of the form 10 through the utilization of additional wands 68 engaged with the frame 72. The container 64 includes an inwardly and donwardly inclined downwardly facing mirror 112 which enables workmen on the deck 80 to determine when the form 10 has been properly filled with concrete. Thus, the entire operation of positioning the form 10 and pouring concrete into the form 10 may be accomplished by workmen standing upon the deck 80.

After the concrete column within the form 10 has been cured, the cables 48 are engaged with the hook 50 and the crane 54 is utilized to exert an upward pull on the outer frame 12. After initial upward displacement of the frame 12 relative to the inner frame 28, the angulation of the links 40 will effect an outward pull on each of the sides 30 and 32 in order to displace the latter away from the opposing sides of the cured concrete column 116. Thereafter, continued upward movement of the hook 50 will lift the form 10 above the poured column 116.

Figure 5:
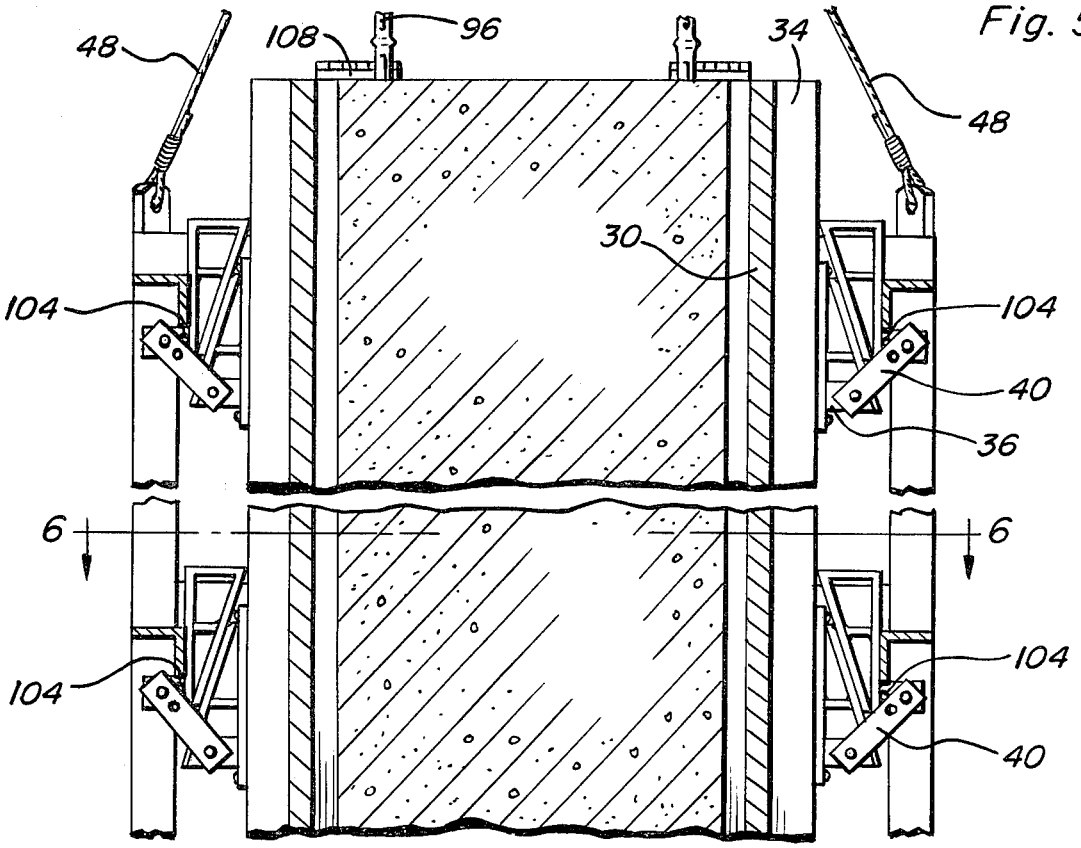
FIG. 5 is an enlarged fragmentary vertical sectional view taken substantially upon the plane indicated by the section line 5—5 of FIG. 4.

It will be noted from FIG. 5 of the drawings that the wedge structures 36 and 38 not only serve to cause final inward wedging of the sides 30 and 32 of the inner frame 28 as the outer frame 12 is lowered to its lower position, but also limit downward movement of the inner frame 28 as well as outward movement of the sides 30 and 32 when the frame 12 lifted relative to the frame 28. Thus, positioning of the form 10 in proper position and closing of the sides 30 and 32 as well as stripping the sides 30 and 32 from the poured column 116 and the lifting of the form 10 from the poured column 116 may all be effected merely by the operator of the crane 54.

The pendulum support 58 includes a lateral arm structure 118, see FIG. 1 including a pair of pulleys 120 between which the cable 152 passes. The pulleys 120 comprise guides which assure that the support 58 substantially parallels the cable 152 and thereby positions the television camera to view straight downwardly over the container 64 supported from the hook 50. In this manner, the operator of the crane 54 may substantially precisely position the container 64 relative to the form 10.

It is also pointed out that since the sides 30 and 32 move inward and outward upon final downward and initial upward movement of the outer frame 12 relative to the inner frame 28, the flaps 108 need not be pivotally mounted.

Also, the form may be used in single or multiple pairs of inner and outer panels disposed in parallel or relatively angulated positions. In this manner the form may be used in forming one or more sides of a straight wall, the under side of a deck, or in forming shearwalls, beams, wall buttresses and deck voids.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A column form including an outer upstanding peripheral frame having a plurality of peripherally extending outer sides, an inner frame having an equal number of inner sides spaced inward from corresponding outer sides of said outer frame, upper and lower parallelogram links pivotally connected at opposite ends to each pair of corresponding outer and inner sides, means for lifting the outer frame, upper and lower pairs of coacting inner and outer wedge means carried by each pair of corresponding inner and outer sides engageable with each other upon downward displacement of said outer frame relative to said inner frame to limit such downward displacement to a lower position of said outer frame with said links substantially horizontally disposed and also engageable with each other upon upward displacement of said outer frame relative to said inner frame to limit such upward displacement to an upper limit position of the outer frame with said links upwardly and outwardly inclined.

2. The column form of claim 1 wherein said outer and inner sides include vertically extending opposite side marginal edge portions, each pair of corresponding inner and outer sides including coacting upper and lower pairs of said inner and outer wedge means spaced along each pair of corresponding side marginal edge portions thereof and each pair of corresponding side marginal edge portions including upper and lower links pivotally connected at opposite ends to said inner and outer sides.

3. The column form of claim 1 wherein said inner sides, when said outer frame is in said lower position, defines a peripherally continuous polygonal frame, each corner portion of said inner frame including horizontally inwardly projecting abutment means at the upper end thereof against which the upper end of a reinforcing rod disposed within said inner frame may abut.

4. The column form of claim 3 wherein each of said abutment means in hingedly supported from a corresponding inner frame side for upward and outward swinging relative thereto toward a retracted position outward of the inner surface of the corresponding inner frame side.

5. The column form of claim 1 wherein said wedge means carried by said inner and outer sides comprise upwardly and downwardly facing wedges, respectively, substantially equally oppositely inclined relative to the vertical.

6. The column form of claim 1 wherein remote corner portions of the lower end of said outer frame include support arm portions pivotally supported therefrom at inner ends of said arm portions for horizontal swinging movement of said arm portions about vertical axes, the free ends of said arm portions including downwardly facing vertically adjustable foot means.

7. The column form of claim 6 wherein said outer frame comprises a quadralateral polygon, said arms being swingable relative to said outer frame through an arc of approximately 270°.

8. The column form of claim 6 including a plumb bob assembly, said plumb bob assembly including a vertical tubular body substantially filled with a motion dampening fluid, a weighted plumb bob line centrally suspended in the upper end of said tubular body, means carried by said body for removable support on each of said outer sides of said outer frame, said tubular body defining transverse through viewing zones through which said lines may be observed from the exterior of said tubular body.

9. The column form of claim 1 including a crane supported suspension line from the lower end of which a fluid concrete airial container of the type including a downwardly displacable dump valve actuator and a lower peripherally extending rail member is supported, an elongated operating handle including a first end adapted to be gripped by a user and a second end including a laterally opening C-shaped head thereon releasably laterally engageable with said valve actuator and rail member.

10. The column form of claim 9 wherein said container includes a downwardly and inwardly inclined underside portion, an inclined and downwardly facing mirror supported from said underside portion.

11. The column form of claim 9 including support structure guided from said crane line and supporting a downwardly facing closed circuit television camera.

12. A concrete form section including inner and outer walls disposed in spaced apart opposing relation, a plurality of spaced parallelogram links pivotally connected at opposite ends to said inner and outer walls, pairs of coacting inner and outer wedge means carried by said inner and outer walls engageable with each other upon first direction displacement of said outer wall relative to said inner wall to limit such displacement to a first position of said outer wall with said links disposed substantially normal to said walls and engageable with each other upon displacement of said outer wall relative to said inner wall in the opposite direction to limit such opposite direction displacement to a limit position of the outer wall with said links inclined relative to said walls.

13. The concrete form section of claim 12 wherein said outer and inner walls include opposite side marginal edge portions, the inner and outer walls including coacting pairs of said inner and outer wedge means spacing along each pair of corresponding side marginal edge portions and each pair of corresponding side marginal edge portions including links pivotally connected at opposite ends to said inner and outer walls.

14. The concrete form section of claim 12 wherein said wedge means carried by said inner and outer walls comprise oppositely facing wedges substantially equally oppositely inclined relative to said walls.

* * * * *